US007308221B2

(12) United States Patent
An et al.

(10) Patent No.: US 7,308,221 B2
(45) Date of Patent: Dec. 11, 2007

(54) HIGH DEVELOPING VOLTAGE SUPPLY APPARATUS

(75) Inventors: Seung-deog An, Yongin (KR); Min-seon Kim, Suwon (KR); Woo-jung Shim, Suwon (KR)

(73) Assignee: Samsung Electronics, Co., Ltd., Suwon-Si (KR)

( * ) Notice: Subject to any disclaimer, the term of this patent is extended or adjusted under 35 U.S.C. 154(b) by 382 days.

(21) Appl. No.: 10/600,468

(22) Filed: Jun. 23, 2003

(65) Prior Publication Data

US 2004/0067078 A1 Apr. 8, 2004

(30) Foreign Application Priority Data

Oct. 8, 2002 (KR) ..... 10-2002-0061210

(51) Int. Cl.
*G03G 15/08* (2006.01)

(52) U.S. Cl. ..... 399/235; 399/228; 399/285

(58) Field of Classification Search ..... 399/285, 399/385, 299, 306, 228, 222, 234, 235
See application file for complete search history.

(56) References Cited

U.S. PATENT DOCUMENTS

| | | | | |
|---|---|---|---|---|
| 4,415,254 | A * | 11/1983 | Nishikawa | 399/171 |
| 5,099,278 | A * | 3/1992 | Sato | 399/75 |
| 5,262,828 | A * | 11/1993 | Oka et al. | 399/55 |
| 5,376,998 | A | 12/1994 | Suzuki | |
| 5,627,722 | A * | 5/1997 | Hirst | 361/170 |
| 6,724,410 | B2 * | 4/2004 | Arai | 347/115 |

FOREIGN PATENT DOCUMENTS

| | | | |
|---|---|---|---|
| JP | 61-208062 | | 9/1986 |
| JP | 61254960 | A * | 11/1986 |
| JP | 63301079 | * | 12/1988 |
| JP | 05-197254 | | 8/1993 |
| JP | 08-334951 | | 12/1996 |
| JP | 08334951 | A * | 12/1996 |
| JP | 2000-194180 | | 7/2000 |

OTHER PUBLICATIONS

Chinese Office Action issued May 12, 2006 in Chinese Patent Application No. 03126397.6 which corresponds to U.S. Appl. No. 10/600,468.

* cited by examiner

*Primary Examiner*—Quana Grainger
(74) *Attorney, Agent, or Firm*—Staas & Halsey LLP

(57) ABSTRACT

A high developing voltage supply apparatus includes solenoid power switches, and a high developing voltage driver selectively outputting a solenoid driving signal to close one of the solenoid power switches to electrically close a corresponding mechanical contact, applying a high developing voltage to one of color development rollers corresponding to the mechanical contact closed and Kased on an image to be printed. A high developing voltage supply supplies the high developing voltage to developing roll shafts of the other color development rollers to stabilize potentials of the developing roll shafts, or, in the alternative, the high developing voltage supply apparatus may include a voltage supply supplying a self-biased voltage to the other color development rollers using the high developing voltage formed with a DC voltage $V_{DC}$ and an AC voltage $V_{AC}$ superimposed.

8 Claims, 6 Drawing Sheets

HIGH DEVELOPING VOLTAGE SUPPLY APPARATUS

CROSS-REFERENCE TO RELATED APPLICATIONS

This application claims the benefit of Korean Application No. 2002-61210, filed Oct. 8, 2002, in the Korean Intellectual Property Office, the disclosure of which is incorporated herein by reference.

BACKGROUND OF THE INVENTION

1. Field of the Invention

The present invention relates to a laser printer, and more particularly, to a high developing voltage supply apparatus for developer fixed non-contact-type color laser printers.

2. Description of the Prior Art

A laser printer is a device designed to reproduce images on a printing medium and has advantages of low noise and fast speed. The laser printer generally performs printing jobs on the printing medium while sequentially carrying out operations such as electric charge—exposure to light—development—transfer—cleaning—electric discharge, for which the laser printer is provided with diverse mechanisms and electric circuits.

FIG. 1 is a view schematically showing a structure of a conventional developer-moving color laser printer. The developer-moving color laser printer has an organic photo conductor(OPC) drum 10, an electric charge unit 20, a laser scanning unit(LSU) 30, a development unit 40, a transfer unit 50, and a cleaning unit 60. In addition to the above, the laser printer includes a fixing unit, an electric discharge unit, an electric power supply unit, a high-voltage supply unit, an engine control unit, which are not shown.

The electric charge unit 20 electrically discharges a high-voltage to a surface of the OPC drum 10 to electrically charge the surface of the OPC drum 10 with positive(+) and negative(−) charges.

The LSU 30 scans the surface of the OPC drum 10 with a laser beam, based on an image to be printed to form an electrostatic latent image on the charged surface of the OPC drum 10.

The development unit 40 has development rollers, each associated with a color, and supplies toner on the surface of the OPC drum 10 on which the electrostatic latent image is formed.

The transfer unit 50 has a transfer belt 50*a* and a convey unit 50*b* moving the belt 50*a*, so as to transfer to the printing medium a toner image developed on the OPC drum 10.

Further, the cleaning unit 60 is closely installed nearby the surfaces of the OPC drum 10 and the transfer belt 50*a*, respectively, to remove the toner remaining on surfaces of the OPC drum 10 and the transfer unit 50.

In the laser printer as described above, the electric charge unit 20 electrically charges the surface of the OPC drum 10, and the LSU 30 scans the electrically charged surface of the OPC drum 10 with the laser beam based on the image to be printed so as to form the electrostatic latent image on the surface of the OPC drum 10. Further, the toner is applied to the surface of the OPC drum 10 through individual development rollers K, M, C, and Y by color, of the development unit 40 Accordingly, the toner image is formed on the surface of the OPC drum 10. At this time, the individual development rollers K, M, C, and Y are initially spaced at a predetermined distance from the OPC drum 10, and only the development roller K, M, C, or Y for the color to be used for printing moves toward a direction of the OPC drum 10 by a driving development unit in the development unit 40. Further, the development roller K, M, C, or Y keeps a predetermined gap from the OPC drum 10 and performs the development by an applied voltage. Thereafter, the toner image formed on the surface of the OPC drum 10 is transferred to the surface of the transfer belt 50*a*, and the toner image transferred to the transfer belt 50*a* is transferred again to the printing medium being fed. The image-transferred printing medium is fixed onto the printing medium by the fixing unit (not shown) and externally discharged from the printer. At this time, the toner remaining on the transfer belt 50*a* and the OPC drum 10 is removed by a blade 60*a* of the cleaning unit 60 contacted on the surfaces of the belt 50*a* and the drum 10 so that the belt 50*a* and the drum 10 can be prepared for a next image. Once removing of the toner is completed, the electric charges existing on the surface of the OPC drum 10 are removed in order for the drum 10 to return to the initial state.

In the printing process of the above developer-moving color laser printer, the development of the toner image is achieved by sequentially moving the individual development rollers Y, M, C, and K, that is, yellow(Y), magenta(M), cyan(C), and Klack(B) toners to the surface of the OPC drum 10 based on color characteristics of image data.

Further, in an operation in which a toner image formed on the surface of the OPC drum 10 is transferred to the printing medium, the toner image formed on the surface of the OPC drum 10 is superimposed and transferred onto the transfer belt 50*a*, and the toner image superimposed onto the transfer belt 50*a* is transferred on the printing medium at one time. Accordingly, in order to print one color image, the OPC drum 10 and the transfer belt 50*a* has four times a revolution speed respectively.

However, the laser printer using the developer-moving non-contact developing method as described above has a problem in that, as the development roller move to the OPC drum 10, the revolution speed of the OPC drum 10 decreases due to a shock of the OPC drum 10 and, as the development rollers are released from the OPC drum 10, the revolution speed of the drum 10 increases so that bending occurs on the printing medium due to the changes to the revolution speed of the OPC drum 10.

In order to solve the problem of deterioration of the image quality due to the changes of the revolution speed of the OPC drum 10 in the developer-moving non-contact laser printer as described above, a developer-fixed non-contact laser printer has been developed to carry out the developments while keeping a certain gap from the OPC drum 10 without moving the development rollers Y, M, C, and K.

The developer-fixed laser printer performs developments without moving the developers in the state that all of the development rollers Y, M, C, and K maintain a predetermined gap from the OPC drum 10, respectively. Further, a high developing voltage supplied to the respective developers is controlled in use of mechanical contacts.

FIG. 2 is a view showing an electrical circuit for a high developing voltage supply apparatus of the conventional developer-fixed non-contact color laser printer. The high developing voltage supply apparatus has a high developing voltage power supply (HVPS) 42 for supplying the high voltage in order for the toner to move to the OPC drum 10 from the fixed development rollers Y, M, C, and K by color respectively, a high voltage driver 44 for selectively outputting a high voltage color drive signal to apply a high developing voltage supplied from the high developing voltage supply 42 to respective color development rollers Y, C, M, and K based on the images to be printed, and solenoid power switches $S_Y$, $S_C$, $S_M$, and $S_K$ switching the high developing voltages supplied from the high developing voltage supply 42 to the color development rollers Y, C, M, and K in response to a color driving signal outputted from the high voltage driver 44. In FIG. 2, a reference numerals '$C_{A*}$' denote a capacitance due to a gap between the individual color development rollers Y, M, C, and K and the OPC drum 10, and 'CP' capacitance of the OPC drum 10 of a dielectric substance.

In order to perform the developments in the non-contact-type color laser printer, the high voltage is supplied by adding an AC voltage to a DC voltage because an electric field decreases in an inverse proportion to the gap of the OPC drum 10 and the development rollers Y, M, C, and K causes toner to move from development roller Y, M, C, or K to the OPC drum 10. That is, when a high AC voltage $V_{AC}$ is applied to the development roller, the toner moves to the OPC drum 10 if a developing vector is negative when a minus toner is used. The toner in the developer does not move if the developing vector is positive, because a direction in which the toner moves is determined based on the developing vector (a DC component of a developing bias—a potential of the surface of the OPC drum 10).

FIG. 3 and FIG. 4 are views for showing a voltage waveform and an electric field waveform, respectively, when the AC voltage is superimposed to the DC voltage. Because the developing vector is positive, the toner is not applied to the OPC drum 10, but stays on the surface of the development roller. Further, if the developing vector becomes negative, the component of a developing electric field toward the OPC drum 10 becomes relatively larger so that the toner is applied to the OPC drum 10.

However, in the developer-fixed laser printer as above, when a developing operation is performed, a development roller to which a high developing voltage is not applied has charges induced from the charges of the surface of the development roller and an ambient charges because the metal shaft of the developer roll is installed floated so that the potential of the metal shaft becomes very unstable. Accordingly, if a development has been made on the surface of the OPC drum 10 by a color toner of one of the development rollers and the developing vector becomes positive, as shown in FIG. 5, the toner developed on the surface of the OPC drum 10 by a preceding color developer reversely moves to the surface of the the one of the development rollers, causing a problem of producing cross contamination upon printing. The cross contamination changes the colors of the image, which becomes a cause degrading image quality.

SUMMARY OF THE INVENTION

In order to solve the above problems, according to an aspect of the present invention, there is provided a high developing voltage supply apparatus for developer-fixed non-contact color laser printers, which stably maintains potentials of respective metal shafts of development rollers not performing developing operations to enable high-quality printings.

Additional aspect and/or advantages of the invention will be set forth in part in the description which follows and, in part, will be obvious from the description, or may be learned by practice of the invention.

According to an aspect of the present invention, includes a high developing voltage supply supplying a high developing voltage to developer roll shafts of fixed color development rollers to transfer toner to an organic photo conductor (OPC) drum from the fixed color development rollers; a high developing voltage driver selectively outputting a high voltage driving signal based on an image to be printed to selectively apply the high developing voltage to one of the fixed color development rollers; developer power switches switching the high developing voltage supplied to the fixed color development rollers in response to the high voltage driving signal output from the high voltage driver; and a DC voltage supply supplying a predetermined DC voltage to the other fixed color development rollers excluding the one of the fixed color development rollers supplied with the high developing voltage.

In here, the high developing voltage comprises a DC voltage and an AC voltage superimposed.

The DC voltage supply includes a DC voltage supply providing the predetermined DC voltage; and resistors connected between the DC voltage supply and the fixed color development rollers to supply the predetermined DC voltage output from the DC voltage supply to the other fixed color development rollers for developing operations of the image to be printed, as the high developing voltage is applied to the one of fixed color development roller for the developing operations.

According to an aspect of the present invention, there is provided another high developing supply apparatus includes a high developing voltage supply supplying a high developing voltage to developing roll shafts of developers in order for toner to move from a plurality of fixed color developers to an OPC drum; a high developing voltage driver for selectively outputting a high voltage driving signal based on an image to be printed in order for the high developing voltage to be selectively applied to the fixed color development rollers; developer power switches switching the high developing voltage to the fixed color developers in response to the high voltage driving signal; and a voltage divider dividing and supplying the high developing voltage to the fixed color developers remaining except for the fixed color developer supplied with the high developing voltage.

In here, the DC level of the high developing voltage is set to be a negative voltage when the toner is an electrically negative toner and is set to be a positive voltage when the toner is an electrically positive toner.

The voltage divider divides the high developing voltage with the resistors connected between the one of the fixed color development rollers selected for developing operations and the other fixed color development rollers not selected for the developing operations, and the resistors are determined based on an impedance formed by a capacitance due to a gap between the OPC drum and each of the fixed color development rollers and capacitance due to the OPC drum.

According to an aspect of the present invention, there is provided a high developing voltage supply apparatus including solenoid power switches; a high developing voltage driver selectively outputting a solenoid driving signal to close one of the solenoid power switches to electrically close a corresponding mechanical contact, applying a high developing voltage to one of color development rollers corresponding to the mechanical contact closed and Kased on an image to be printed; and a high developing voltage supply supplying the high developing voltage to developing roll shafts of the other color development rollers to stabilize potentials of the developing roll shafts.

According to an aspect of the present invention, there is provided a high developing voltage supply apparatus including solenoid power switches; a high developing voltage driver selectively outputting a solenoid driving signal to close one of the solenoid power switches to electrically close a corresponding mechanical contact, applying a high developing voltage to one of color development rollers corresponding to the mechanical contact closed and Kased on an image to be printed; and a voltage supply supplying a self-biased voltage to the other color development rollers using the high developing voltage formed with a DC voltage $V_{DC}$ and an AC voltage $V_{AC}$ superimposed.

As stated above, the high developing voltage supply apparatus, according to an aspect of the present invention, can prevent toner developed on a surface of an OPC drum from further moving to a developing roll because developers remaining except for one of the developers performing the developing operations become stable with a predetermined DC potential based on a high developing voltage or a DC voltage provided from the DC voltage supply.

BRIEF DESCRIPTION OF THE DRAWINGS

These and/or other aspects and/or advantages of the invention will become apparent and more readily appreciated from the following description of the embodiments, taken in conjunction with the accompanying drawings of which.

DETAILED DESCRIPTION OF THE PREFERRED EMBODIMENT

Figure 1:
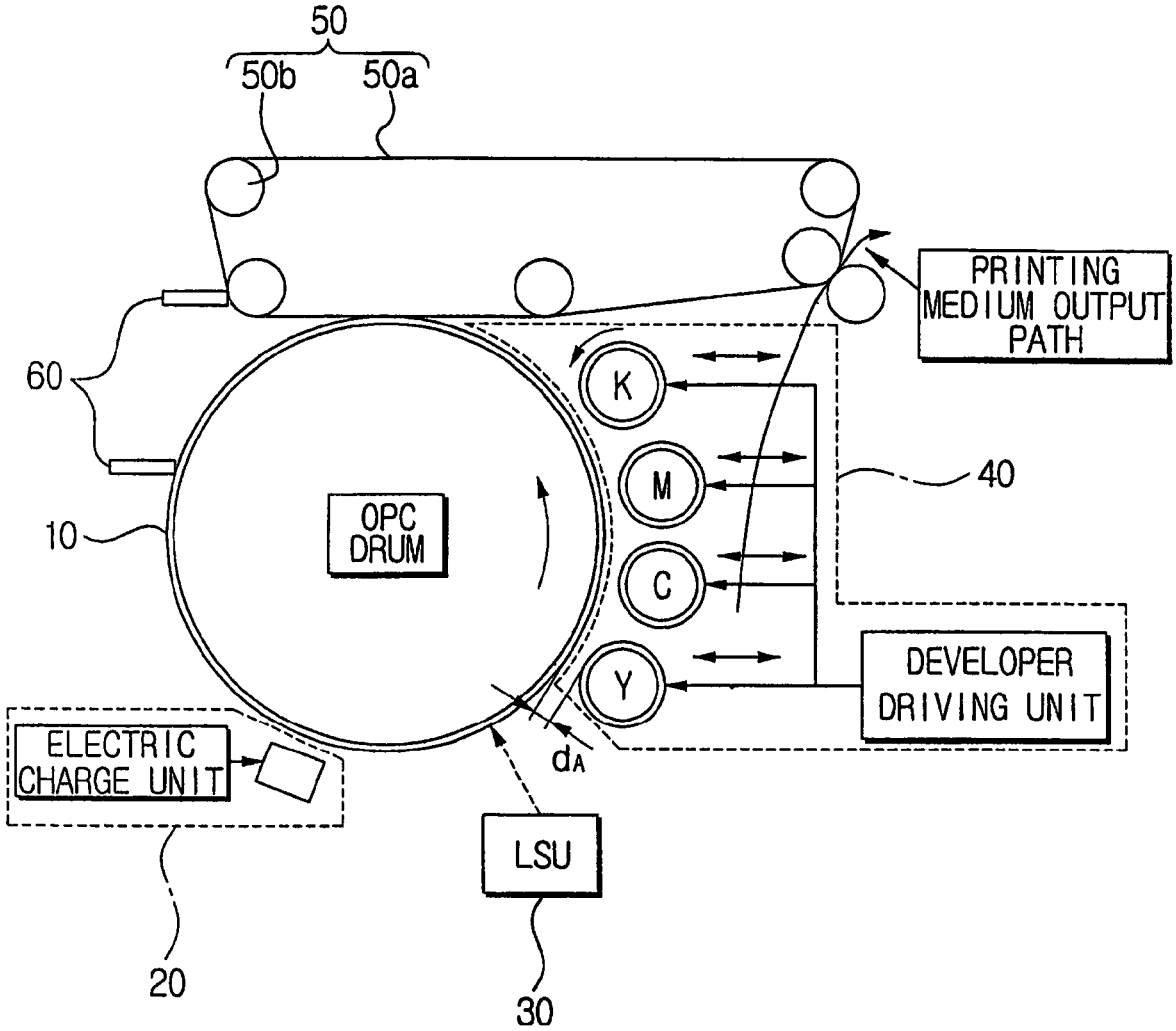
FIG. 1 (PRIOR ART)
FIG. 1 is a view schematically showing a structure of a conventional developer-moving color laser printer.
Figure 2:
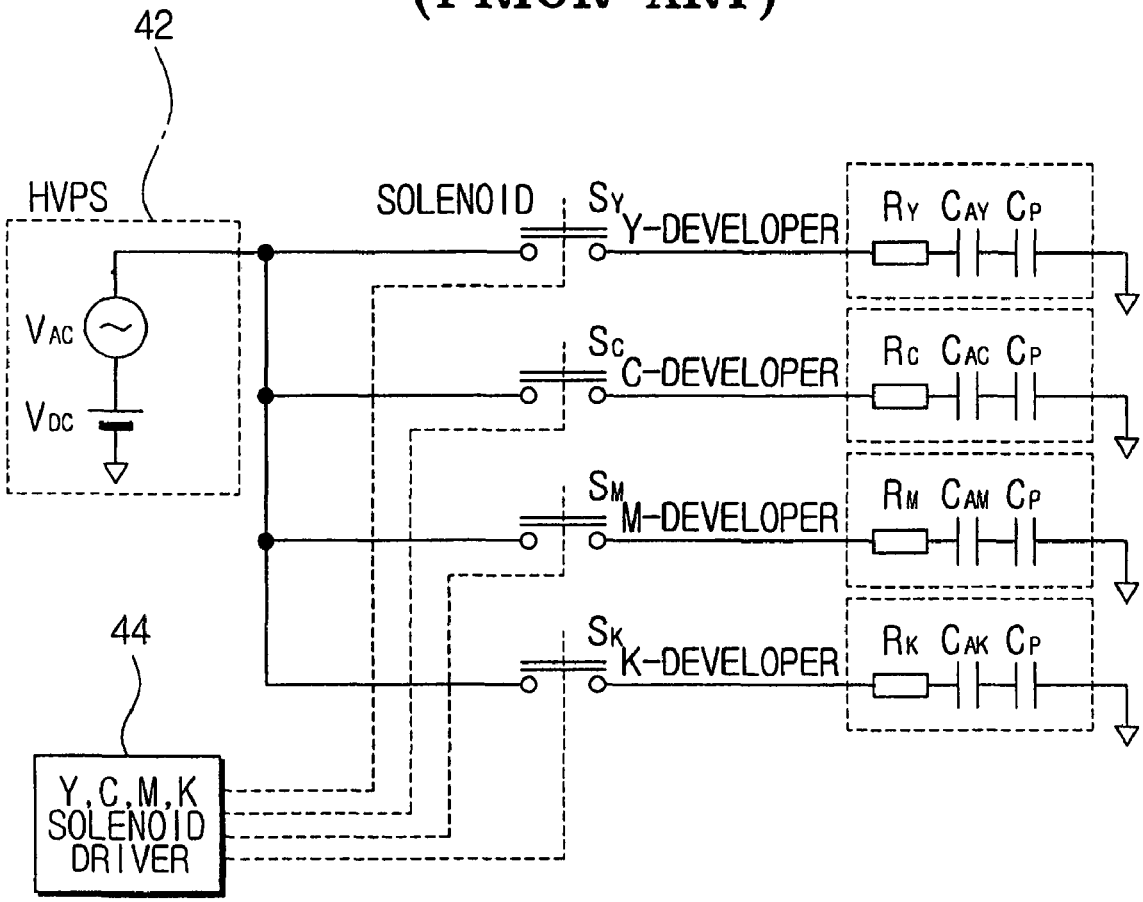
FIG.2 (PRIOR ART)
FIG. 2 is a view showing an electrical circuit for a high developing voltage supply apparatus of a conventional developer-fixed color laser printer.
Figure 3:
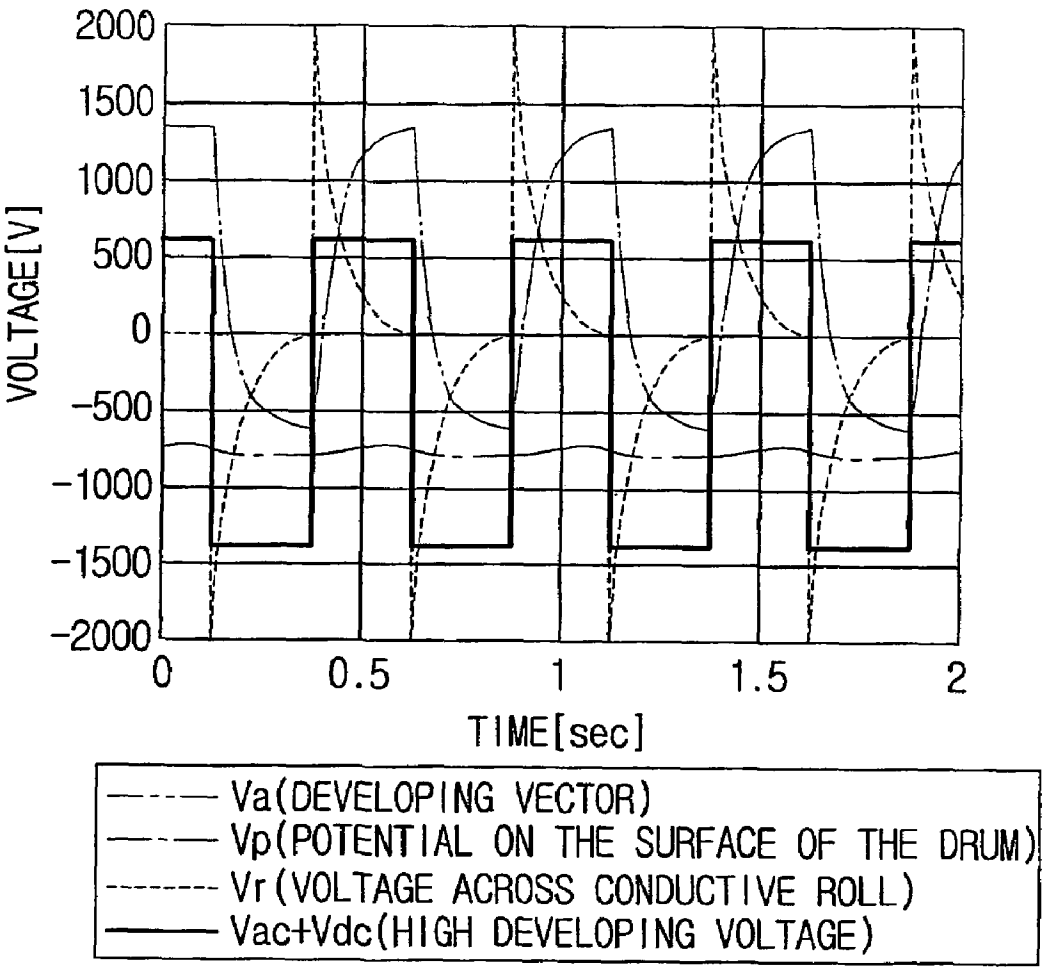
FIG.3 (PRIOR ART)
FIG. 3 and FIG. 4 are views showing a voltage waveform and an electric field waveform when a DC voltage is superimposed on an AC voltage.
Figure 4:
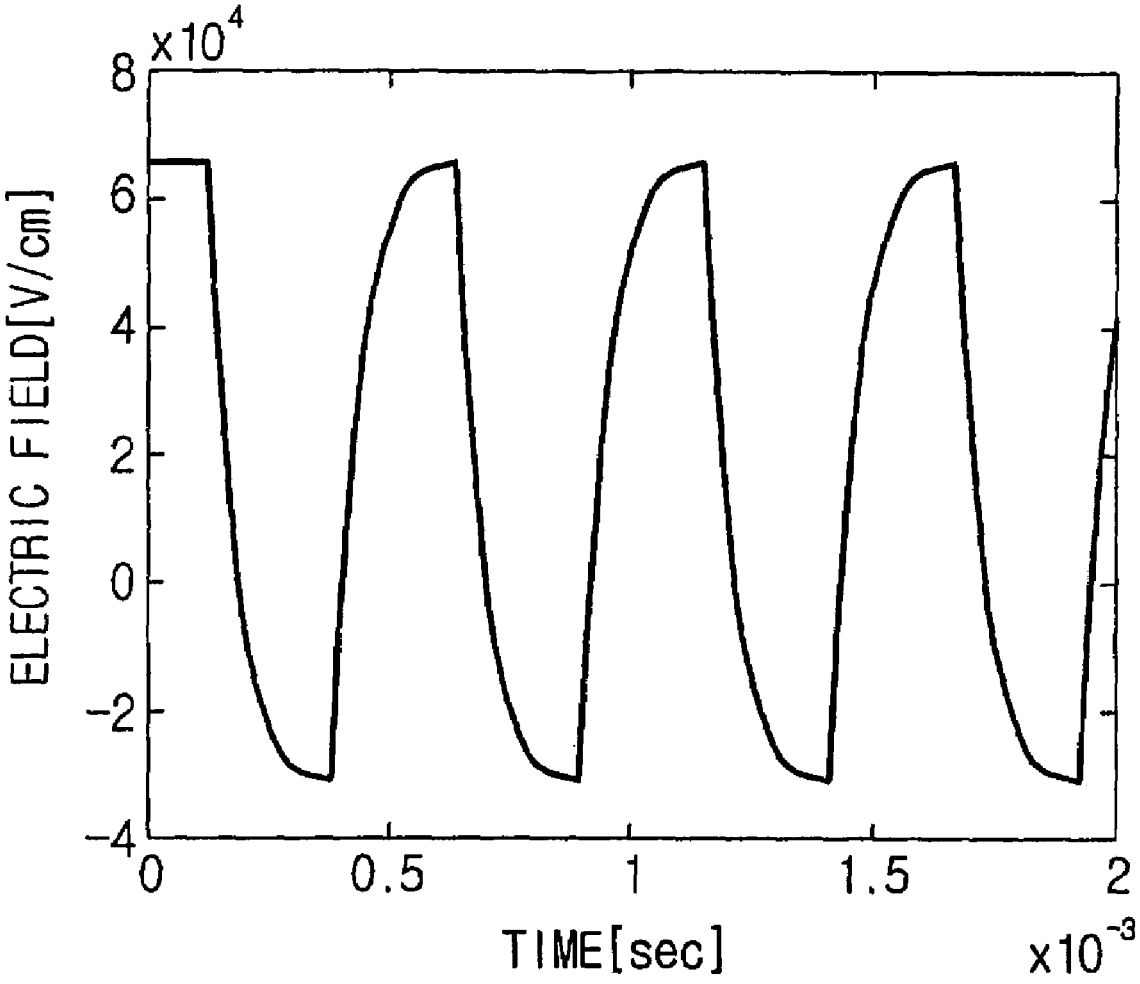
FIG.4 (PRIOR ART)
Figure 5:
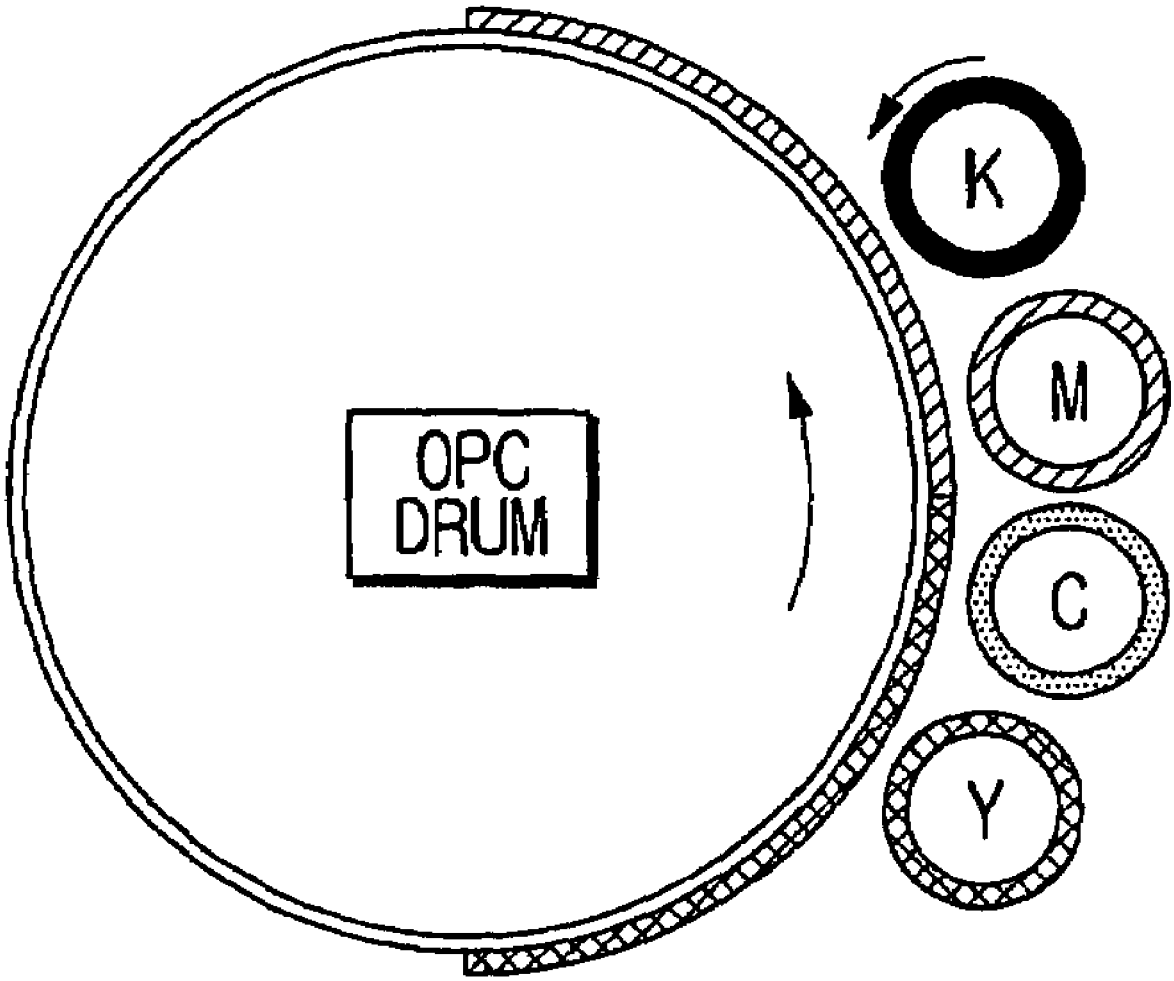
FIG.5 (PRIOR ART)
FIG. 5 is a view explaining cross contamination.

Reference will now be made in detail to the aspects of the present invention, examples of which are illustrated in the accompanying drawings, wherein like reference numerals refer to like elements throughout. The aspects are described below in order to explain the present invention by referring to the figures.

Figure 6:
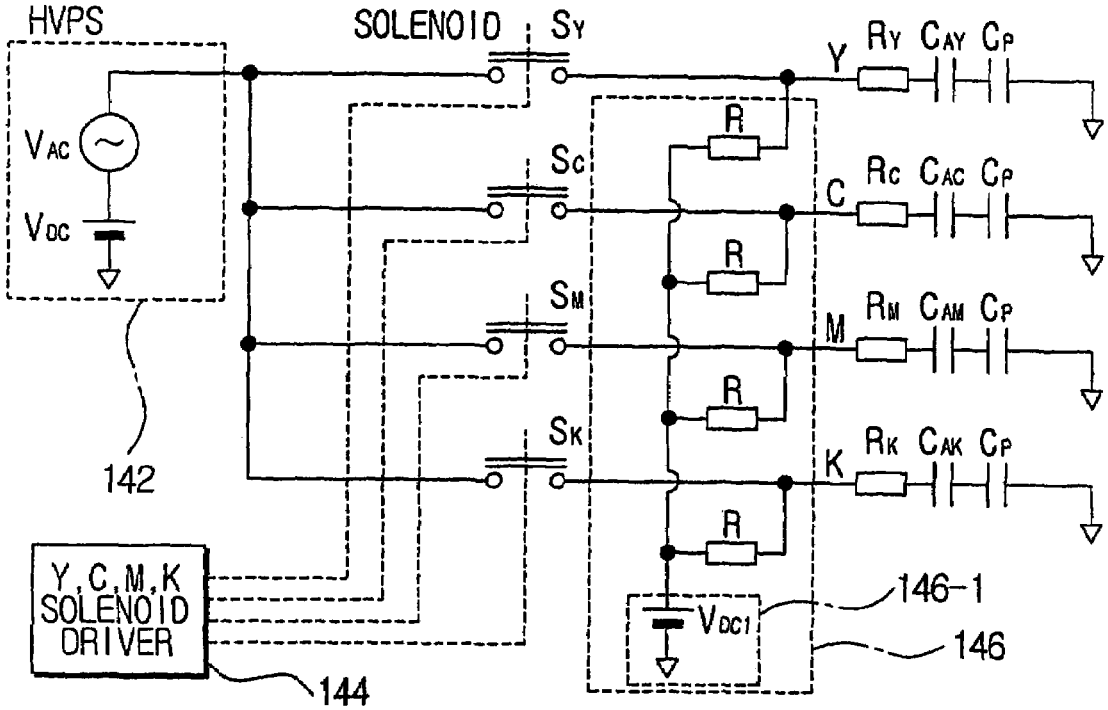
FIG. 6 is a view showing an electrical circuit of a high developing supply apparatus, according to an aspect of the present invention.

FIG. 6 is a view showing an electrical circuit of a high developing voltage supply apparatus, according to an aspect of the present invention. The high developing voltage supply apparatus includes a high developing voltage supply 142, a high developing voltage driver 144, developer solenoid power switches $S_Y$, $S_C$, $S_M$, and $S_K$, and a DC voltage supply 146.

The high developing voltage supply 142 supplies to developing roll shafts $R_Y$, $R_C$, $R_M$, and $R_K$ corresponding to individual development rollers Y, C, M, and K (not shown) a high developing voltage formed of an AC voltage $V_{AC}$ and a DC voltage $V_{DC}$ superimposed in order for toner to move to an OPC drum 10 from the respective fixed development rollers Y, C, M, and K.

The high developing voltage driver 144 selectively outputs a developer solenoid driving signal based on an image to be printed.

The developer solenoid power switches $S_Y$, $S_C$, $S_M$, and $S_K$ close or open mechanical contacts corresponding to the developer solenoid driving signal output from the high developing voltage driver 144 so as to transmit the high developing voltage output from the high developing voltage supply 142 to the developing roll shafts $R_Y$, $R_C$, $R_M$, and $R_K$ of the respective development rollers Y, C, M, and K.

The DC voltage supply 146 includes a first DC voltage supply 146-1 supplying a predetermined DC voltage $V_{DC1}$ and resistors R connected between the first DC voltage supply 146-1 and the respective color development rollers Y, C, M, and K, and supplies the predetermined DC voltage $V_{DC1}$ to the development rollers Y, M, C, and K not selected for developing operations when the high developing voltage provided from the high developing voltage supply 142 is applied to one of the developers Y, C, M, and K selected for the developing operations.

The high developing voltage supply apparatus, as described above, selectively outputs the solenoid driving signal from the high developing voltage driver 144 to electrically close the mechanical contacts of one solenoid power switch out of the four solenoid power switches $S_Y$, $S_C$, $S_M$, and $S_K$. Thereafter, the solenoid power switch corresponding to the selectively output solenoid driving signal turns on with the mechanical contacts closed, to apply the high developing voltage to the development roller Y, C, M, or B selected. At this time, the developing roller shafts $R_Y$, $R_C$, $R_M$, and $R_K$ of the development rollers Y, C, M, and K not selected is supplied with the DC voltage $V_{DC1}$ output from the first DC voltage supply 146-1. For example, in case that toner is electrically negative and a yellow color is developed for the printing image, the high developing voltage driver 144 outputs the solenoid driving signal to the solenoid power switch $S_Y$ corresponding to the yellow color development roller Y. Thereafter, the solenoid power switch $S_Y$ for the yellow color turns on with corresponding mechanical contacts closed, and switches the high developing voltage output from the high developing voltage supply 142 to the metal shaft $R_Y$ of the yellow color development roller Y Further, the negative DC voltage $V_{DC1}$ output from the first DC voltage supply 146-1 is applied to the development rollers C, M, and K, respectively.

As above, if the negative DC voltage $V_{DC1}$ is applied to the metal developing roll shafts $R_C$, $R_M$, and $R_K$ of the three remaining developing rollers not selected, the metal shafts $R_C$, $R_M$, and $R_K$ are not in the floating state any more, thus, the metal shafts $R_C$, $R_M$, and $R_K$ are stabilized in a level of applied DC voltage $V_{DC1}$. Accordingly, the developing vector between the surface of the OPC drum and the respective development rollers M, C, and K decreases, so that the toner developed on the OPC drum by the preceding development roller Y does not move any further towards the development rollers M, C, and K not selected. At this time, if the toner is the electrically positive toner, the first DC voltage supply is set to output the positive voltage so as to supply a positive voltage to the development rollers M, C, and K not selected.

Figure 7:
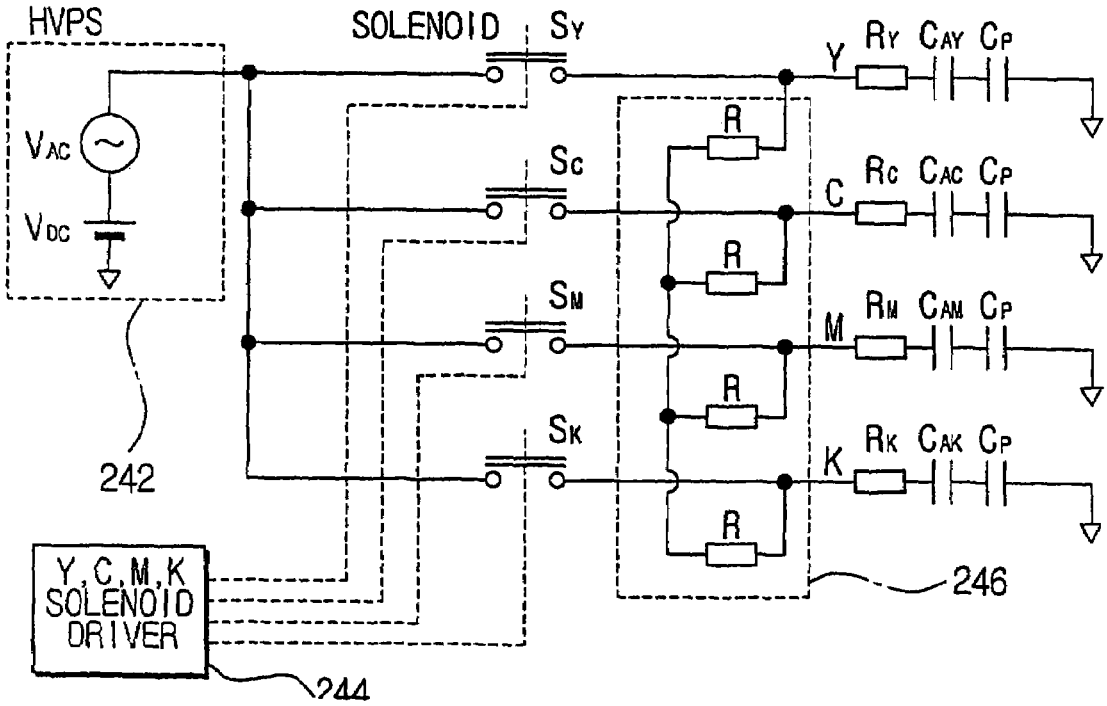
FIG. 7 is a view showing an electrical circuit of the high developing supply apparatus, according to another aspect of the present invention.

FIG. 7 is a view showing an electric circuit of the high developing voltage supply apparatus, according to another aspect of the present invention. The high developing voltage supply apparatus, rather than supplying the DC voltage from a separate DC voltage supply to the metal shafts of the color development rollers C, M, and K not selected, as in the aspect shown in FIG. 6, the high developing voltage supply apparatus is constructed to apply a self-biased voltage using the high developing voltage formed with the DC voltage $V_{DC}$ and the AC voltage $V_{AC}$ superimposed. That is, for the respective developing roll metal shafts $R_C$, $R_M$, and $R_K$ for the colors not selected, the voltage divided by a voltage divider through the two resistors is applied. In here, resistors R are determined in consideration of the impedances such as developing gap capacitance, and OPC drum capacitance of the development rollers Y, M, C, and K in order to obtain an appropriate self-biased voltage.

The above high developing voltage supply apparatus sets the DC level of the high developing voltage formed with the DC voltage and the AC voltage superimposed to provide the negative voltage in case that toner is the electrically negative toner and to provide a positive voltage in case that toner is the electrically positive toner. Accordingly, if the toner is electrically negative, the self-biased voltage supplied to the color development rollers not selected becomes the negative level alike. If the toner is electrically positive, the self-biased voltage becomes the same positive level. Therefore, the developing vector decreases as in the aspect shown in FIG. 6 so that toner movements do not occur any further from the OPC drum to the development rollers not selected for developing operations.

As stated above, because the high developing voltage supply apparatus of the developer-fixed non-contact-type laser printer, according to an aspect of the present invention, applies an appropriate DC voltage depending upon a toner corresponding to developing roller metal shafts of the development rollers not selected for developing operations. Accordingly, the developing vector with the surface of the OPC drum decreases preventing cross contamination due to the toner previously developed on the surface of the OPC drum and carrying out high-quality printings.

Although a few aspects of the present invention have been shown and described, it would be appreciated by those skilled in the art that changes may be made in this embodiment without departing from the principles and spirit of the invention, the scope of which is defined in the claims and their equivalents.

What is claimed is:

1. A high developing voltage supply apparatus, comprising:

a high developing voltage supply supplying a high developing voltage to developing roll shafts of developers in order for toner to move from a plurality of fixed color development rollers to an OPC drum;

a high developing voltage driver for selectively outputting a high voltage driving signal based on an image to be printed in order for the high developing voltage to be selectively applied to the fixed color development rollers;

developer power switches to selectively switch the high developing voltage to a select fixed color development roller, of the plurality of fixed color development rollers, in response to the high voltage driving signal; and a voltage divider dividing and supplying the high developing voltage, as selectively switched-to the select fixed color development roller, to remaining fixed color development rollers, of the plurality of fixed color development rollers except the select fixed color development roller, to bias the remaining fixed color development rollers through voltage dividing of the high development voltage provided to the select fixed color development roller, wherein the high developing voltage comprises a DC voltage and an AC voltage superimposed.

2. The high developing voltage supply apparatus as claimed in claim 1 wherein the voltage divider provides a negative voltage when the toner is an electrically negative toner and provides a positive voltage when the toner is an electrically positive toner.

3. The high developing voltage supply apparatus as claimed in claim 2, wherein the voltage divider divides the high developing voltage with the resistors inter-connected between the select fixed color development roller and the remaining other fixed color development rollers.

4. The high developing voltage supply apparatus as claimed in claim 3, wherein values of the resistors are determined based on an impedance formed by a capacitance due to a gap between the OPC drum and each of the fixed color development rollers and capacitance due to the OPC drum.

5. A high developing voltage supply apparatus, comprising:

solenoid power switches;

a high developing voltage driver selectively outputting a solenoid driving signal to close one of the solenoid power switches to electrically close a corresponding mechanical contact, applying a high developing voltage to a select color development roller, of a plurality of color development rollers, corresponding to the mechanical contact closed and based on an image to be printed; and a voltage divider to divide the high developing voltage supplied to the select color development roller and apply the divided high developing voltage to developing roll shafts of remaining color development rollers, of the plurality of color development rollers except the select color development roller, to bias and stabilize potentials of the developing roll shafts of the remaining color development rollers, wherein when an electrically negative toner is used, a DC voltage of negative level is included in the high developing voltage, and, when a positive toner is used, a DC voltage of positive level is included in the high developing voltage.

6. A high developing voltage supply apparatus, comprising:

solenoid power switches;

a high developing voltage driver selectively outputting a solenoid driving signal to close one of the solenoid power switches to electrically close a corresponding mechanical contact, applying a high developing voltage to a select color development rollers, of a plurality of color development rollers, corresponding to the mechanical contact closed and based on an image to be printed; and a voltage divider to divide the high developing voltage supplied to the select color development roller and apply the divided -the high developing voltage to developing roll shafts of remaining color development rollers, of the plurality of color development rollers except the select color development roller, to bias and stabilize potentials of the developing roll shafts of the remaining color development rollers, wherein the high developing voltage applied to a developing roll shafts of the select color development roller, a high developing voltage formed of an AC voltage and a DC voltage superimposed to transfer toner from the select color development roller& to an OPC drum.

7. A high developing voltage supply apparatus, comprising:

solenoid power switches;

a high developing voltage driver selectively outputting a solenoid driving signal to close one of the solenoid power switches to electrically close a corresponding mechanical contact, applying a high developing voltage to a select color development rollers, of a plurality of color development rollers, corresponding to the mechanical contact closed and based on an image to be printed; and a voltage divider to divide the high developing voltage supplied to the select color development roller and apply the divided the high developing voltage to developing roll shafts of remaining color development rollers, of the plurality of color development rollers except the select color development roller, to bias and stabilize potentials of the developing roll shafts of the remaining color development rollers, wherein the solenoid power switches selectively close and open mechanical contacts corresponding to the solenoid driving signal output from the high developing voltage driver to selectively transmit the high developing voltage to a developing roll shaft of the select color development rollers.

8. The high developing voltage supply apparatus as claimed in claim 6, wherein a developing vector between a surface of the OPC drum and the remaining development rollers decreases, so that the toner developed on the OPC drum by the select development roller does not move towards the remaining development rollers.

* * * * *

UNITED STATES PATENT AND TRADEMARK OFFICE

CERTIFICATE OF CORRECTION

PATENT NO. : 7,308,221 B1
APPLICATION NO. : 10/600468
DATED : December 11, 2007
INVENTOR(S) : Seung-deog An et al.

It is certified that error appears in the above-identified patent and that said Letters Patent is hereby corrected as shown below:

On the title page, item [56]:
Column 2 (Foreign Patent Documents), Line 3, after “63301079” insert --A--.

Column 7, Line 67, after “1” insert --,--.

Column 8, Line 46, change “rollers,” to --roller,--.

Column 8, Line 59, change “shafts” to --shaft--.

Column 8, Line 60, before “a high” insert --is--.

Column 8, Line 62, change “roller&” to --roller--.

Column 9, Line 8, change “rollers,” to --roller,--.

Column 10, Line 8, change “rollers.” to --roller.--.

Signed and Sealed this

Third Day of June, 2008

JON W. DUDAS
*Director of the United States Patent and Trademark Office*